United States Patent [19]

Welter

[11] Patent Number: 4,709,489

[45] Date of Patent: Dec. 1, 1987

[54] SHOCK ABSORBING ASSEMBLY FOR AN ATHLETIC SHOE

[76] Inventor: Kenneth F. Welter, 889 Heritage Dr., Addison, Ill. 60101

[21] Appl. No.: 765,845

[22] Filed: Aug. 15, 1985

[51] Int. Cl.[4] ..... A43B 21/30

[52] U.S. Cl. ..... 36/27; 36/38

[58] Field of Search ..... 36/35 R, 28, 37, 38, 36/27, 35 B, 36 B, 92; 128/614, 618

[56] References Cited

U.S. PATENT DOCUMENTS

| | | | |
|---|---|---|---|
| 134,088 | 12/1872 | Monzani | 36/38 |
| 211,178 | 1/1879 | Pease | 36/38 |
| 394,188 | 12/1888 | Johnson | 36/38 |
| 485,813 | 11/1892 | Hooper | 36/38 |
| 495,373 | 4/1893 | Roche | 36/38 |
| 555,402 | 2/1896 | Richey | 36/37 |
| 614,688 | 11/1898 | Barber | 36/38 |
| 658,234 | 9/1900 | Cartier | 36/38 |
| 674,636 | 5/1901 | Priestman | 36/38 |
| 887,368 | 5/1908 | Willet | 36/38 |
| 897,032 | 8/1908 | Thompson | 36/76 R |
| 959,513 | 5/1910 | Gordon | 36/38 |
| 968,020 | 8/1910 | Yandoll | 36/37 |
| 1,029,019 | 6/1912 | Levan | 36/38 |
| 1,383,067 | 6/1921 | Borman | 36/38 |
| 1,708,683 | 4/1929 | Roberts | 36/38 |
| 1,942,312 | 1/1934 | Tutoky | 36/38 |
| 2,074,050 | 3/1937 | Dwyer | 36/37 |
| 2,078,551 | 4/1937 | Williams | 36/38 |
| 2,198,228 | 4/1940 | Pinaud et al. | 36/35 R |
| 2,357,281 | 8/1944 | Williams | 36/38 |
| 2,394,281 | 2/1946 | Williams | 36/38 |
| 2,814,132 | 11/1957 | Montoscuro | 36/37 |
| 2,967,362 | 1/1961 | Montoscuro | 36/37 |
| 3,214,849 | 11/1965 | Nadaud | 36/38 |
| 3,290,801 | 12/1966 | Bente | 128/614 |
| 3,902,260 | 9/1975 | Massella et al. | 36/35 R |
| 4,168,585 | 9/1979 | Gleichner | 128/614 |
| 4,245,406 | 1/1981 | Landay et al. | 36/14 |
| 4,316,335 | 2/1982 | Giese et al. | 36/129 |
| 4,322,893 | 4/1982 | Halvorsen | 36/43 |
| 4,530,173 | 7/1985 | Jesinsky, Jr. | 128/614 |
| 4,546,555 | 10/1985 | Spademan | 36/28 |

FOREIGN PATENT DOCUMENTS

| | | | |
|---|---|---|---|
| 25265 | of 1910 | United Kingdom | 36/35 B |
| 410452 | 5/1934 | United Kingdom | 36/35 B |
| 2032761 | 5/1980 | United Kingdom | 36/35 B |
| 2145615 | 4/1985 | United Kingdom | 36/28 |

*Primary Examiner*—Henry S. Jaudon
*Assistant Examiner*—Steven N. Meyers
*Attorney, Agent, or Firm*—Wood, Dalton, Phillips, Mason & Rowe

[57] ABSTRACT

A shock absorbing assembly for an athletic shoe having a resilient metal plate in the form of a beam which is supported at its end portions by a pair of laterally spaced relatively non-compressible supports. Included between the spaced supports is an open area to permit downward deflection of the metal plate between the supports caused by the weight of a person wearing the shoe whereby the application of downward pressure on the heel portion by a person wearing the shoe downwardly deflects the resilient plate and cradles the heel of said person.

14 Claims, 10 Drawing Figures

FIG. 5
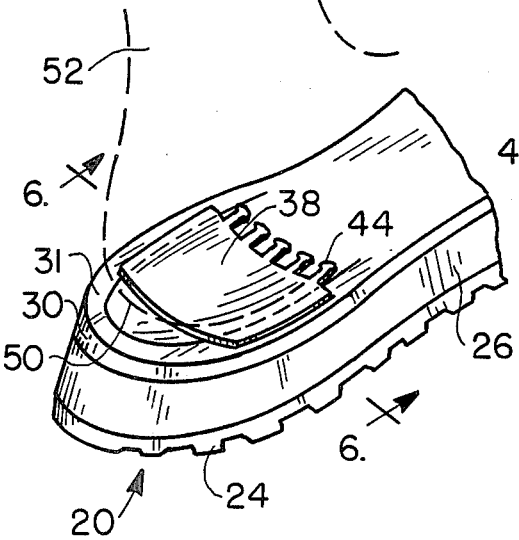
FIG. 6
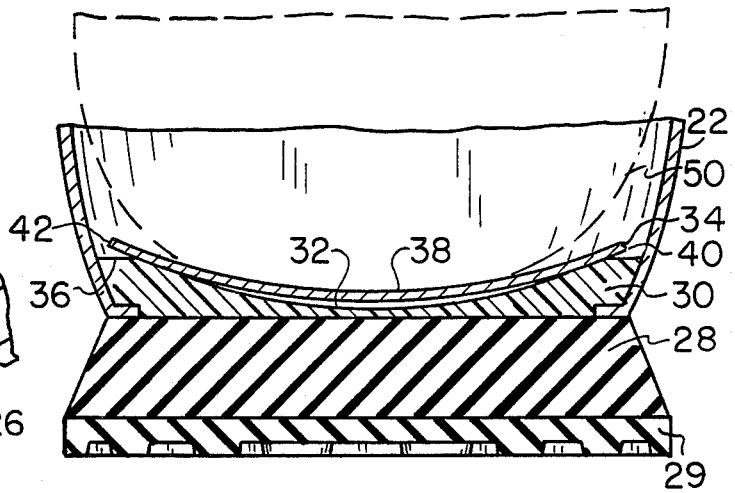
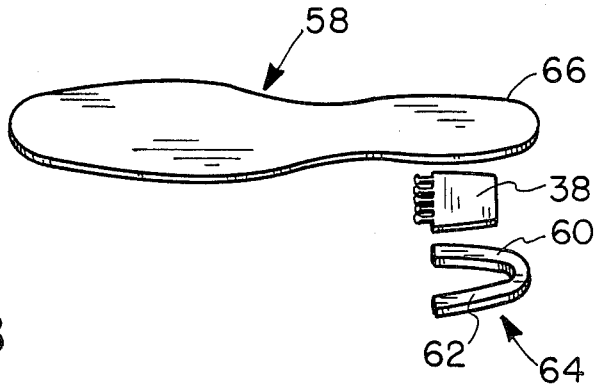
FIG. 7
FIG. 8
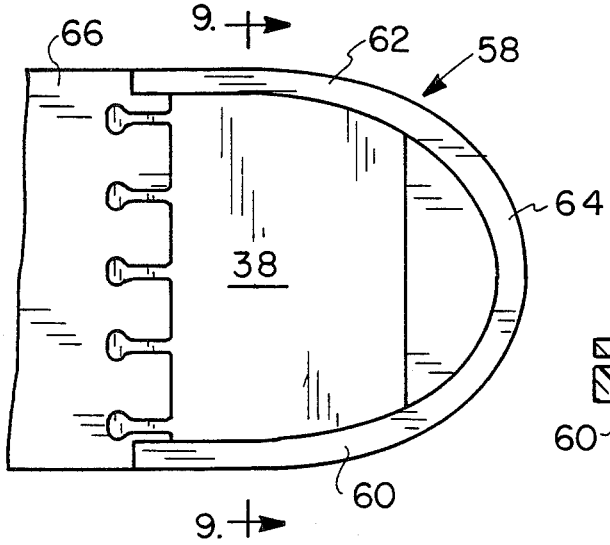
FIG. 9
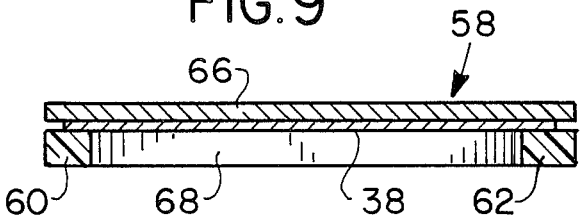
FIG. 10
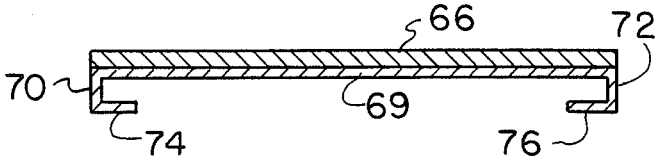

SHOCK ABSORBING ASSEMBLY FOR AN ATHLETIC SHOE

TECHNICAL FIELD

This invention relates generally to athletic shoes and more specifically to a shock absorbing assembly for an athletic shoe.

BACKGROUND OF THE INVENTION

Recently there has been an increased awareness of the many benefits associated with being physically fit. One particular form of exercise used ro achieve and maintain physical fitness has been running or jogging.

Most joggers have a running style in which the heel strikes initially, after which the foot is rolled successively forwardly to the mid-part of the foot, tne metatarsals and the toes which provide tne impetus for the next stride. A minority of joggers simply land substantially on the full lengtn of the foot.

A recent study estimates that 34 million Americans run or jog on a regular basis. The exercise of jogging is accompanied for many runners with nagging muscular and skeletal injuries such as tendonitis, shin splints and joint problems, especially in the knee and foot. The upper and lower leg and intermediate knee joint actually operate as a shock absorber during running. Since the knee joint is one of the most fragile joints of the body, it is very desirable to reduce the forces acting upon the knee joint as much as possible.

The muscular and joint skeletal injuries are augmented by the fact that running causes a force of two to three times the body weight on the runner which must be absorbed by the muscular-skeletal structure of the leg and body. An isolated impact causes minimal harm, but for a jogger who runs several miles every day, the repetitive forces frequently cause muscular and joint discomfort in the knee, foot and leg.

Some runners are so-called "full foot strikers" while others are so-called "heel strikers". The "heel strikers" run so as to cause the heel initially to contact or strike the ground. Thereafter, the foot is rolled forwardly into successive ground contact throughout its entire length, and "push off" for the next stride is provided by the metatarsal and toe areas of the foot. The "full foot strikers" run so that the entire length of each foot strikes the ground at substantially the same time, and "push off" mechanics for the next strike is generally accomplished as in the case of "heel strikers" pointed out above.

In either case, depending upon the muscular skeletal structure of the foot, knee, upper and lower leg, and hip, the upright or vertical axis of the foot is generally not in alignment with the vertical or upright axis of the lower leg. When the foot axis is inclined inwardly of the leg axis, this condition is referred to as "pronation" of the foot. When the foot axis is inclined outwardly of the leg axis, this condition is referred to as "supinaiton" of the foot.

The majority of runners have a foot and leg conformation causing pronation of the foot. Limited pronation (up to an angle of 10°) is believed to be desirable as being a natural motion which absorbs some of the impact forces when a jogger's foot strikes the ground. However, excessive pronation exerts excessive force and torque on the foot and knee to a magnified degree often resulting in injury, muscular discomfort and joint discomfort in the knee, foot and leg.

The minority of runners have a foot and leg conformation causing supination of the foot. Again, from a force and torque standpoint as pointed out above, excessive supination likewise causes the undesirable effects referred to above.

For the past decade designers have attempted to create jogging shoes by striking a balance among the factors of durability, cushioning, reduced weight, flexibility and stability to the heel and foot itself. Many prior art designs of running shoes utilize cushioning material in an attempt to ease the forces applied to the knee, foot and leg during running. A cushioning material commonly used in the midsole and heel areas of a shoe is a plastic foam formed from a mixture of ethylene vinyl and acetate. This plastic foam includes a myriad of tiny, variable sized gas bubbles, each bubble being encapsulated by a wall of the plastic foam. Such a plastic foam absorbs shock forces in running but has exhibited poor durability because of the breakdown in the plastic foam walls during use which greatly decreases the cushioning property of the plastic foam. Furthermore, such plastic foam materials exhibit relatively high degrees of hysteresis during loading resulting in inefficient use of energy and do not provide a sufficient degree of stability to the foot during running.

More recently shoe midsole and heel materials are being made from polyurethane foam. This foam also contains a myriad of tiny air spaces somewhat in bubble form but these air spaces are connected by tortuous pathways somewhat like the interstices of a sponge. This type of structure allows air to migrate from one portion of the midsole to another when the foam is compressed. It is more durable than the bubble plastic foam, but is firmer and has less of a cushioning effect. Additionally, it has the same deficiencies as other elastomeric materials, as pointed out above.

Alternate prior art shock absorbing means for shoes utilize various forms of metal springs, such as coils or cantilevers, or pockets of oil or air in the heel area of the shoe. However, results obtained from any of these methods have proven only partially satisfactory, often resulting in a shoe more difficult and expensive to produce.

Further, none of the aforementioned shock absorbing means provide a structure which will substantially and effectively cradle the heel during jogging; which will provide added stability to the heel and foot during running; which has a useful life greater than the life of the shoe; and which has predictable resilient flexibility to cushion the heel and thereafter reapply a substantial portion of the absorbed force to the heel during a stride in running.

The present invention is directed to overcoming one or more of the problems as set forth above.

SUMMARY OF THE INVENTION

An object of this invention is to provide a new and improved shock absorbing assembly for an athletic shoe wherein a resiliently flexible plate having the mechanical attributes of a beam supports the heel of a person wearing the shoe. The plate or beam is supported at each of its opposite ends by a pair of laterally spaced, relatively non-compressible (i.e. firm) supports which are part of the heel portion of the shoe. A chamber is preferably provided in the heel portion beneath the plate, although a readily compressible material could be used beneath the plate and between the supports. Thus during running, the forces caused by the shoe heel striking a surface will deflect the plate arcuately downwardly into the chamber to absorb the forces and cradle the runner's heel, the plate assuming a substantially uniform curve laterally throughout its length when subjected to said forces. The plate has the physical properties of elasticity and resilient flexibility so that it quickly returns to its original shape as the applied forces are withdrawn. The dimensions of the plate may be varied depending upon the weight of the runner and the particular forces which are applied. The material used need have predictable properties so that similarly formed plates will perform in the same manner. Preferably the plate has sufficient resistance to the applied forces so that, under anticipated loading, energy absorption is maximized while at the same time the arcuately deflected plate is prevented from striking the bottom of the chamber in the heel portion.

Another object is to provide a shock absorbing assembly for removable mounting in an athletic shoe, the assembly having a resilient metal plate to support the heel of a person wearing the shoe and being of a thickness to be arcuately downwardly deflected by pressure applied by said person upon the metal plate. The metal plate is supported and retained at each end by a pair of laterally spaced slightly compressible, but firm, supports as referred to above. Also secured to the metal plate, on the side opposite the supports, is an insole member made of a relatively soft compressible material, the insole member being of a shape to fit inside the athletic shoe. The shock absorbing assembly also includes means intermediate the spaced supports (a chamber or readily compressible material) to permit downward deflection of the metal plate between said supports caused by the weight of the person wearing the shoes. The application of downward pressure on the heel portion by the person wearing the shoe with the shock assembly downwardly deflects the resilient plate and cradles the heel of said person.

A further object of this invention is to provide a shock absorbing assembly for an athletic shoe having a resilient metal plate which includes forward projecting fingers to provide greater comfort to the person wearing the athletic shoe.

BRIEF DESCRIPTION OF THE DRAWINGS

FIG. 5 is a broken perspective view of the sole portion of a shoe, with the insole and upper portion of the shoe removed, showing the plate of the present invention being deflected by heel applied forces;

FIG. 6 is an enlarged cross section taken as indicated along line 6—6 of FIG. 5;

FIG. 7 is an exploded view of an alternate embodiment of the present invention;

FIG. 8 is a plan view of the embodiment of FIG. 7 taken from the underside of FIG. 7;

FIG. 9 is a cross section taken as indicated along 9—9 of FIG. 8; and FIG. 10 is a cross section, similar to that in FIG. 9, of a further embodiment of the present invention showing an alternate form of plate and spaced supports for the plate.

DESCRIPTION OF THE PREFERRED EMBODIMENTS

Figure 1:
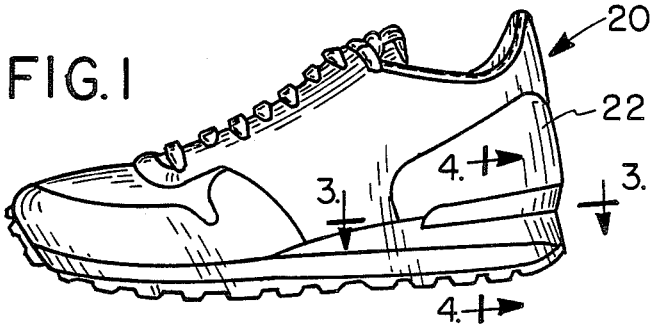
FIG. 1 is a perspective view of an athletic shoe using the present invention.

Referring first to FIG. 1, there is shown a typical running or jogging shoe 20. The jogging shoe 20 has an upper 22 which surrounds the sides and top of the foot, and an outsole 24 generally consisting of a layer of durable rubber with a pattern of treads or studs.

Figure 2:
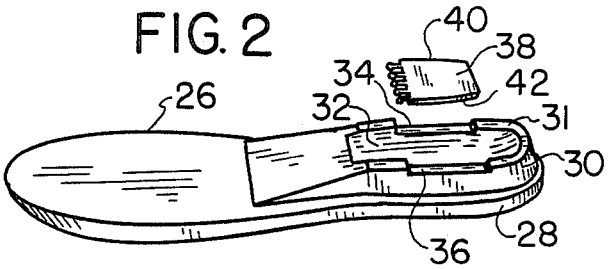
FIG. 2 is a detailed view showing the midsole and heel area of the shoe in FIG. 1.

A midsole 26, shown in FIG. 2, is a layer of padding for providing cushioning for a foot of a person wearing the shoe 20. The midsole includes a heel portion 28 located at the back end of the shoe. In the preferred embodiment of the present invention, the heel portion 28 of the midsole 26 has a raised heel wedge 30 secured thereto. A relatively non-compressible material is preferably used for said heel wedge 30.

The heel wedge 30 is generally horseshoe shaped to conform with the shape at the back end of the shoe 20 within which it is mounted. An upper rim 31 of the heel wedge 30 affords a raised surface providing a hollowed out chamber or section 32 extending between opposite sides of the rim. This chamber may be filled with a readily compressible material. Indentations or seats 34, 36 (each with fore and aft abutments) are formed in each of the opposite sides of the rim 31. The dimensions of the indentations 34, 36 are determined by the width and thickness of a plate 38 which is supported and retained at each of its opposite end portions in the seats 34, 36. The indentations or seats 34, 36 thereby act as laterally spaced supports for the plate 38. The plate 38 may be formed of any material having the physical properties as described hereinabove.

The plate 38 is preferably formed of a resiliently flexible metal, for example, 0.035 inch thick stainless steel, alloyed and heat treated to maximize yield strength and to ensure retention of resilient flexibility throughout its life in a running shoe. While this gauge of steel may be used in the preferred embodiment, adjustments in the dimensions of the steel may be made according to the size and weight of the person using the shoe containing the plate.

While FIG. 2 shows the heel wedge 30 as being of unitary construction, this support could in fact be provided by two individual spaced support members located at opposite sides of the heel portion 28 of the midsole 26.

The metal plate 38 includes end portions 40 and 42 with the space between the end portions being sized so as to support the heel of a person wearing the shoe 20. The precise thickness of the metal plate 38 used will be that necessary for the metal plate 38 to be arcuately downwardly deflected by pressure applied by said person on the metal plate.

Additionally, the metal plate 38 has a plurality of forward projecting fingers 44 positioned laterally across the front edge 46 of the metal plate 38 for providing a comfortable transition from high contact pressure during heel impact to zero contact pressure without undesirable stiffening of the forward edge 46 of the metal plate 38. Without the forward projecting fingers 44, the front edge 46 of the metal plate 38 may cause some discomfort each time pressure is applied, and subsequently released, against this forward edge 46.

While the particular finger 44 profile may take on varying shapes, in the preferred embodiment the tip 48 of the finger 44 is considerably wider than that portion closest to the forward edge 46 of the metal plate 38. The fingertips are broad in order to spread out the effect of the contact pressure exhibited by the metal plate 38.

The shoe 20 also has an insole 49 secured in the normal manner throughout its length within the shoe, said insole in the heel portion being positioned above the heel wedge 30 and midsole 26. The insole may be made of a soft compressible material, such as foam or leather, to support the bottom of the foot. As can be seen from FIGS. 2–4, the insole 49, seats 34,36, and their abutments cooperate to maintain plate end portions 40,42 and plate 38 in its operative position at all times.

Figure 4:
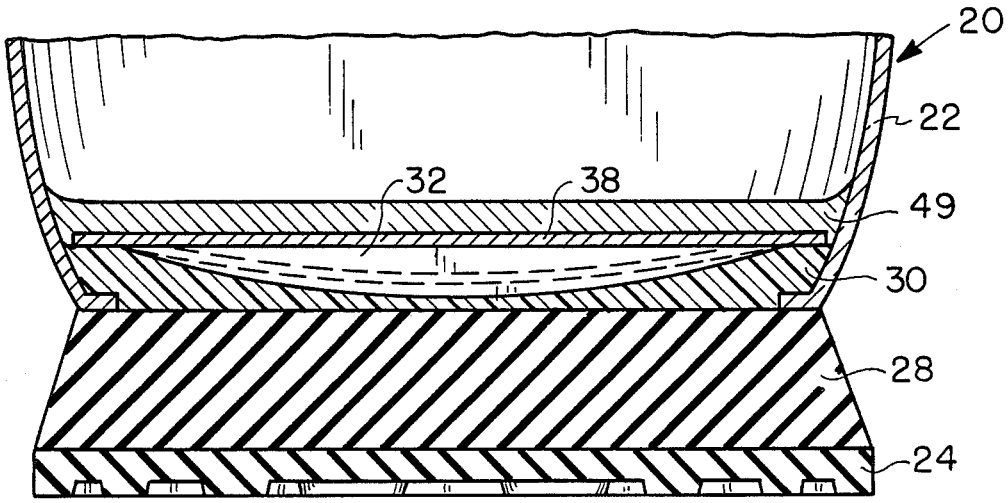
FIG. 4 is a further enlarged cross section taken as indicated along line 4—4 in FIG. 1.

As better illustrated in FIG. 4, when the shoe is not in use the metal plate 38 will remain in a virtually horizontal plane. The metal plate 38 is also shown, in dashed lines, in the downwardly deflected position which it would assume when downward pressure is applied on the metal plate 38. Although not shown, in some cases, it may be desirable to provide the metal plate 38 with a concave surface within which the heel can rest with no heel forces applied.

FIG. 5 shows (without the insole) a cut away view of an athletic shoe 20 having the shock absorbing assembly of the present invention while the shoe is being worn. As discussed above, a heel 50 of a person's foot 52 is resting on the metal plate 38. When downward pressure is applied by the heel 50, such as when the heel portion of shoe 20 strikes the ground while running, the metal plate 38 will be arcuately downwardly deflected to form a longitudinal trough as shown in FIG. 6. In determining the thickness of the metal to be used, there are at least two general considerations. First, as discussed above, the metal plate 38 should be dimensioned such that it will resiliently deflect downwardly under pressure, as shown. Secondly, the metal plate 38 should have sufficient resistance to downward deflection so that under maximum anticipated load the bottom of the metal plate 38 will just come in contact with the bottom portion of the hollowed out area 32 of the heel wedge 30. Any loading beyond maximum anticipated load will allow the metal plate 38 to "bottom out" into the heel wedge which serves as a secondary (albeit less efficient) shock absorber, and a support to prevent permanent deformation of plate 38.

As can be seen with reference to FIG. 6, an important feature of the shock absorbing assembly of the present invention is the ability of the metal plate 38 to arcuately deflect laterally so as to cradle the heel 50 and to provide added stability to the entire foot of a jogger.

The plate 38, when arcuately deflected during running, also exerts a limiting influence tending to restrict both excessive pronation and supination. With the heel under load cradled within the arcuately downwardly deflected plate, the heel must roll upwardly on the plate toward plate end portion 42 during pronation which tends to limit the ability of the remainder of the foot to turn inwardly. Conversely, in supination, the heel must roll upwardly on the plate toward plate end portion 40 during supination which tends to limit the ability of the remainder of the foot to turn outwardly. Thus the cradling of the heel in the instant invention is firm, stable, uniform and secure, as contrasted with elastomers in which excessive pronation or supination is enhanced by the failure of the elastomer to stabilize the foot.

Figure 3:
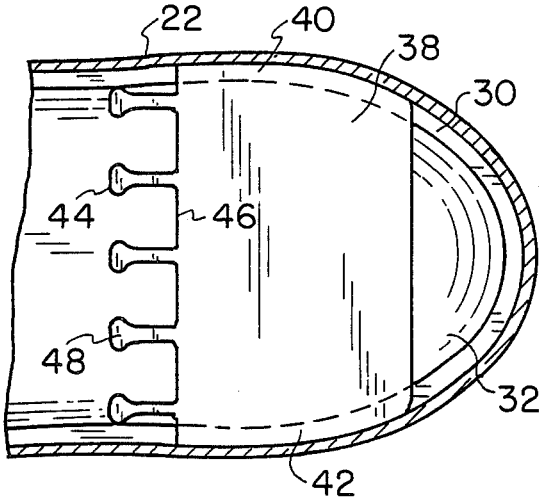
FIG. 3 is an enlarged cross section taken as indicated along line 3—3 in FIG. 1, the section being taken just below the insole and above the plate.

The plate 38 is preferably formed slightly narrower at its rear end portion than at its midportion and forward portion, as shown in FIG. 3. Thus the plate, by virtue of its beam-like properties, arcuately deflects more readily in its longer mid and forward portions as compared to its shorter rear end portion. Such slight difference in deflection under load provides a slight smooth downwardly curved surface extending from the rear forwardly of the plate to afford intimate and close conformance of the plate to the heel during running. The effect of movement of this nature is that the metal plate 38 cradles the heel area 50 thereby providing added stability while jogging.

Furthermore, the use of metal plate 38 in the form of a beam results in a construction substantially more durable than is available with elastomeric materials used in prior art shoes. Because of its physical properties, metal plates 38 (as herein described) can be produced with greater uniformity from piece to piece which affords more consistent and predictable results in the manufacturing process and during usage.

Also, by using a resilient metal plate 38, along with a slightly resilient, but firm, heel wedge 30, a shock absorbing assembly is provided where principally the metal plate will deflect and absorb the forces or energy thus allowing the heel wedge 30 and the midsole 26 to be made of firmer, thinner and lighter materials as such parts need no longer exhibit primary shock absorbency properties. As pointed out above, because of the inherent nature of elastomers, such materials exhibit high hysteresis during a loading cycle resulting in wasted energy which converts principally into heat during running.

The structure as hereinbefore discussed is utilized when the shock absorbing assembly of the present invention is included in an athletic shoe by the original equipment manufacturer. FIG. 7 shows an exploded view of an alternate embodiment of the present invention wherein a shock absorbing assembly 58 may be provided as an insertable insole for prior art shoes.

A pair of laterally spaced support members 60 and 62 are constructed of a slightly resilient, but firm, material. As shown, the support members may be linked together in a horseshoe fashion to provide a unitary support member 64. The metal plate 38 is of similar construction to that discussed above, and may be secured in any known fashion, such as by adhesive, to the two laterally spaced support members 60 and 62. Further provided is an insole member 66 which may be made of a material such as leather or foam. The insole 66 is also secured to the metal plate 38 by any known method.

The completed construction, as shown in FIGS. 8 and 9, is intended to be placed inside a prior art shoe with the laterally spaced support members 60 and 62 resting in the heel area of the shoe. The support members 60 and 62 will again provide a hollow chamber area 68 through which the metal plate 38 may be deflected when downward pressure is applied. In this manner, the benefits of the shock absorbing assembly of the present invention may be obtained while using any prior art shoes previously available. Further, because of the long life resulting from the durability of the metal plate 38 the shock absorbing assembly 58 can be retained after a pair of shoes is discarded and subsequently be used in a different pair of shoes.

FIG. 10 shows a cross section, similar to that of FIG. 9, of still another embodiment of the present invention. A metal plate 69, similar to the metal plate 38 previously discussed, further comprises an integral configuration with lateral sides formed downwardly and inwardly. The downward portions 70 and 72 along with the inward portions 74 and 76 replace the laterally spaced support members 60 and 62. In this embodiment, the metal plate 69 continues to operate as a beam, with the structure consisting essentially of two parts, the metal plate 69 and the insole member 66. Here again, the metal plate 69 and insole 66 may be secured by any known means, such as adhesives.

The metal plate 69 is again of a thickness sufficient to allow the beam to be arcuately downwardly deflected between its opposite sides when pressure is applied by the person on the metal plate. The plate 69 performs or functions in the same manner as discused above in relation to the other embodiments.

Although the structures of FIGS. 7–10 have been described in relation to an insertable insole, such structures may also be incorporated in original equipment athletic shoes if desired.

The use of resilient metal plate in the form of a beam being supported at its ends by a pair of laterally spaced support members provides an improved shock absorbing assembly for an athletic shoe over that available in the prior art. Test results have shown that forces on the muscular-skeletal structure of the leg (particularly the fragile knee joint) are substantially diminished by utilizing the instant invention as compared to running shoes utilizing only elastomeric materials. Furthermore, the structure of the present invention is more durable, more consistent and predictable in nature and maintains comfort and added stability for the person wearing the shoe while running or jogging.

The force or shock absorbing qualities of the present invention are retained in complete measure throughout the life of the shoe. Improved stability is provided for the heel and foot during running by the resilient cradling action of the steel plate or beam upon the heel. Furthermore, the plate or beam has consistent and predictable resilient flexibility which provides improved uniform cushioning from shoe to shoe in the manufacturing process and during use. The assembly not only absorbs the applied force but also reapplies a substantial portion of the absorbed force to the heel during a stride in running.

The foregoing description is given for clearness of understanding only and no unnecessary limitations should be implied therefrom, as modifications will be obvious to those skilled in the art.

I claim:

1. A shock absorbing assembly for an athletic shoe comprising:

a resiliently flexible plate in the form of a beam having a front laterally extending marginal edge portion and laterally spaced opposite end portions, the plate being of a size between the end portions to support the heel of a person wearing the shoe and being of a thickness to be arcuately downwardly deflected by pressure applied by said person upon the plate;

a heel portion positioned within the shoe and provided with a pair of laterally spaced supports, each of said supports being relatively non-compressible, each of the plate end portions bearing upon one of said supports and said front marginal edge portion being unsupported and free to flex intermediate the supports;

means for retaining each of said plate end portions on its respective support; and means intermediate the spaced supports to permit downward deflection of the plate between said supports by the weight of the person wearing the shoe whereby application of downward pressure on the heel portion by a person wearing the shoe downwardly deflects the resilient plate to form a longitudinally trough to longitudinally cradle the heel of said person.

2. The shock absorbing assembly of claim 1 wherein the spacing between supports is narrower at a rear end portion than at a forward portion to thereby provide added stability and progressively increased cradling of the heel from the rear to the front end portion of the beam.

3. The shock absorbing assembly of claim 1, in which the plate is formed of a thin sheet of resiliently flexible steel.

4. The shock absorbing assembly of claim 3 wherein each of the laterally spaced supports is formed integrally with the steel plate.

5. The shock absorbing assembly of claim 3 in which means are provided extending forwardly of and laterally across the front marginal edge portion to distribute and spread pressures applied adjacent said front marginal edge portion.

6. The shock absorbing assembly of claim 3 wherein said front marginal edge portion is provided with a plurality of laterally spaced, forwardly projecting finger members to distribute pressures applied adjacent said front marginal edge portion.

7. The shock absorbing assembly of claim 6 wherein each of the forward projecting finger members has a free end portion which is wider in a lateral direction than the remainder of the finger member.

8. A shock absorbing assembly for removable mounting in an athletic shoe, comprising:

an insole of flexible material having a forward foot-conforming portion and a rear heel portion, the insole being of a size to fit within the shoe;

a resiliently flexible plate having an upper surface and a lower surface, the upper surface being secured to the insole heel portion, the plate being in the form of a beam having a front laterally extending marginal edge portion, opposite laterally spaced end portions and an intermediate portion of a size to support the heel of a person wearing the shoe, and the plate further being of a thickness to be arcuately downwardly deflected by pressure applied by said person upon the plate; and a pair of laterally spaced supports each secured to the lower surface of the plate on one of said opposite end portions, each of said supports being relatively non-conpressible and affording a chamber between said supports and below said lower surface of said plate, and said front marginal edge portion being unsupported and free to flex intermediate said supports to permit downward deflection of said plate under pressure applied to the upper surface of said plate whereby application of downward pressure on the plate by a person wearing the shoe downwardly deflects the resilient plate to form a longitudinal trough to longitudinally cradle the heel of said person.

9. The shock absorbing assembly of claim 8 wherein the spacing between supports is narrower at a rear end portion than at a forward portion to thereby provide added stability and progressively increased cradling of the beam.

10. A shock absorbing assembly as in claim 8, in which the plate is formed of a thin sheet of resiliently flexible steel.

11. The shock absorbing assembly of claim 10 in which means are provided extending forwardly of and laterally across the front marginal edge portion to distribute and spread pressures applied adjacent said front marginal edge portion.

12. The shock absorbing assembly of claim 10 wherein said front marginal edge portion is provided with a plurality of laterally spaced, forwardly projecting finger members to distribute pressures applied adjacent said front marginal edge portion.

13. The shock absorbing assembly of claim 12 wherein each of the forwardly projecting finger members has a free end portion which is wider in a lateral direction than the remainder of the finger member.

14. The shock absorbing assembly of claim 10 wherein each of the laterally spaced supports is formed integrally with the steel plate.

* * * * *

UNITED STATES PATENT AND TRADEMARK OFFICE

CERTIFICATE OF CORRECTION

PATENT NO. : 4,709,489

DATED : December 1, 1987

INVENTOR(S) : Kenneth F. Welter

It is certified that error appears in the above-identified patent and that said Letters Patent is hereby corrected as shown below:

Column 8, line 4, "longitudinally" should be "longitudinal"

Column 8, line 65, before "the beam." insert -- the heel from the rear to the front end portion of--

Signed and Sealed this

Sixth Day of December, 1988

*Attest:*

DONALD J. QUIGG

*Attesting Officer*

*Commissioner of Patents and Trademarks*